US005913989A

United States Patent [19]

Wycliffe et al.

[11] Patent Number: 5,913,989

[45] Date of Patent: Jun. 22, 1999

[54] PROCESS FOR PRODUCING ALUMINUM ALLOY CAN BODY STOCK

[75] Inventors: Paul Wycliffe; Ed Luce, both of Kingston; David J. Lloyd, Bath; John Fitzsimon; Gene Burger, both of Kingston, all of Canada

[73] Assignee: Alcan International Limited, Montreal, Canada

[21] Appl. No.: 08/676,801

[22] Filed: Jul. 8, 1996

[51] Int. Cl.[6] ..... C22F 1/00

[52] U.S. Cl. ..... 148/437; 148/693; 148/697; 148/439; 148/552; 148/551

[58] Field of Search ..... 148/693, 697, 148/439, 552, 551, 437; 164/476, 459, 477

[56] References Cited

U.S. PATENT DOCUMENTS

| | | | |
|---|---|---|---|
| 3,691,972 | 9/1972 | Bylund . | |
| 4,235,646 | 11/1980 | Neufeld et al. | 148/2 |
| 4,282,044 | 8/1981 | Robertson et al. | 148/2 |
| 4,614,224 | 9/1986 | Jeffrey et al. | 164/476 |
| 4,976,790 | 12/1990 | McAuliffe et al. | 148/2 |
| 5,470,405 | 11/1995 | Wyatt-Mair et al. | 148/551 |
| 5,496,423 | 3/1996 | Wyatt-Mair et al. | 148/551 |

FOREIGN PATENT DOCUMENTS 0507411 10/1992 European Pat. Off. .

*Primary Examiner*—Patrick Ryan
*Assistant Examiner*—M. Alexandra Elve
*Attorney, Agent, or Firm*—Cooper & Dunham LLP

[57] ABSTRACT

A process of manufacturing aluminum can body stock involving the following steps. A molten aluminum alloy is prepared, the alloy containing Mg in the range 1.1 to 1.5% by weight, Mn in the range 0.4 to 0.9% by weight, Cu in the range 0.2 to 0.4% by weight, Fe in the range 0.2 to 0.7% by weight, Si in the range 0.07 to 0.3% by weight, all other elements each less than 0.05% by weight to a maximum of 0.2% for all other elements. The alloy is cast in a continuous strip casting process to produce a slab having a thickness of at least 9 mm. The slab is rolled using at least 83% reduction to produce a re-roll strip. The re-roll strip is coiled to form a coil and the coil to cool is allowed to cool naturally. The re-roll strip is then annealed and cold rolled to a final gauge of between 0.26 and 0.4 mm, using a reduction of between 75 and 85%, with no interanneal. The resulting strip can be used as can body stock having a 45 degree earing of less than 3% and a yield strength after stoving of at least 38.5 ksi (265 MPa).

10 Claims, No Drawings

PROCESS FOR PRODUCING ALUMINUM ALLOY CAN BODY STOCK

BACKGROUND OF THE INVENTION

I. Field of the Prior Art

This invention relates to a process for making an aluminum alloy sheet suitable for use as can body stock. It also relates to an alloy sheet product suitable for making can bodies.

II. Description of the Prior Art

Aluminum beverage cans are currently made from sheet—from alloys such as alloys designated as AA3004, AA3104 and similar alloys containing Mg, Mn, Cu, Fe and Si as the principal alloying elements. The sheet is generally made by direct chill (DC) casting an ingot (typically 500 to 750 mm thick) of the desired composition, homogenizing the ingot at temperatures of 580 to 610° C. for periods of 2 to 12 hours, and hot rolling the ingot (employing a mill entry temperature of about 550° C.), thereby reducing it to re-roll sheet of about 2 to 3.5 mm thick. The re-roll sheet is then cold rolled in one or more steps to the final gauge (0.26 to 0.40 mm). Various annealing steps may be used in conjunction with the cold rolling, but are frequently not required.

The alloy and processing conditions are selected to give sufficiently high strength and low earing to enable fabrication of a can body by drawing and ironing (D&I) operations, and sufficiently high strength retention after paint baking that the finished can is adequately strong. The strength is believed to be related to the alloying elements and the amount of cold work done to the final sheet, and the amount of earing is believed to be related to the amount of cube texture developed and retained during processing. It is commonly found that homogenization of a DC cast ingot followed by hot rolling is adequate to generate the necessary cube texture, and subsequent cold rolling is used to control the strength.

The use of continuous casting to produce alloy slab (typically 30 mm in maximum thickness) followed by hot rolling the slab directly (essential in a continuous process without homogenization) to make re-roll sheet has decided advantages in the production of sheet products, in that hot rolling can be carried out without having to reheat a large DC cast ingot.

One such process is disclosed, for example, in U.S. Pat. No. 4,614,224. Following the production of re-roll sheet, this process uses a two step cold rolling with an interanneal step.

Another process is disclosed in U.S. Pat. No. 4,976,790 where a two step cold rolling process is disclosed with an anneal before the first cold rolling step and also an interanneal.

In order to achieve useful combinations of earing and strength in the final product, such processes which include intermediate heat treatment steps have generally been required, making them more difficult to use and more expensive for commercial production. Even when such steps are introduced, the final product does not meet both strength and earing requirements of modern can body stock.

U.S. Pat. No. 5,470,405 discloses a process whereby a continuously cast strip is hot rolled and immediately subject to an annealing step (intermediate cooling is not permitted), followed by a rapid quench The resulting product can then be cold rolled to final gauge without interanneal or similar heat treatments. However, the requirement for immediate anneal step and a rapid quench step requires special mill design, and reduces the flexibility of processing.

There is a need therefore for a process for manufacturing can body stock based on a continuous casting process which is capable of producing a strip having properties meeting modern can and can fabrication requirements, which is made cost effective through the elimination of certain process steps such as interanneals and artificial aging previously considered essential, but which retains the flexibility of such processes.

SUMMARY OF THE INVENTION

An object of the invention is to provide a process for continuous casting an aluminum alloy slab and hot and cold rolling the slab to form can stock.

Another object of the invention is to provide an aluminum alloy sheet product suitable for making can bodies by D&I operations.

In a first embodiment of the invention, there is provided a process of manufacturing can body stock, comprising the steps of:

preparing a molten aluminum alloy containing Mg in the range 1.1 to 1.5% by weight, Mn in the range 0.4 to 0.9% by weight, Cu in the range 0.2 to 0.4% by weight, Fe in the range 0.2 to 0.7% by weight, Si in the range 0.07 to 0.3% by weight, all other elements each less than 0.05% by weight to a maximum of 0.2% for all other elements, casting the alloy in a continuous strip casting process to produce a slab having a thickness of at least 9 mm, rolling the slab using at least 83% reduction to produce a re-roll strip, coiling the re-roll strip to form a coil and allowing the coil to cool naturally, annealing the re-roll strip, and cold rolling the strip to a final gauge of between 0.26 and 0.4 mm, using a reduction of between 75 and 85%, with no interanneal.

In a second embodiment of the invention there is provided An aluminum alloy strip for can body manufacture comprising an aluminum alloy containing Mg in the range 1.1 to 1.5% by weight, Mn in the range 0.4 to 0.9% by weight, Cu in the range 0.2 to 0.4% by weight, Fe in the range 0.2 to 0.7% by weight, Si in the range 0.07 to 0.3% by weight, all other elements each less than 0.05% by weight to a maximum of 0.2% for all other elements, said alloy strip having a yield strength after stoving of at least 38.5 ksi (265 MPa) and a 45° earing of less than 3%, said alloy strip having a thickness of between 0.26 and 0.4 mm, said alloy strip being made by the steps of casting said alloy in a continuous strip casting process to produce a slab having a thickness of at least 9 mm, rolling said slab without homogenization using at least 85% reduction to produce a re-roll strip, coiling said re-roll strip and allowing said coil to cool naturally, annealing said re-roll strip, cold rolling said strip to a final gauge using a reduction of between 75 and 85%, with no interanneal.

It is preferred that the cast strip be rolled to re-roll thickness using at least 90% reduction.

It is preferred that other elements in the aluminum alloy be present at less than or equal to 0.05% each element with a maximum of 0.2% for the total of other elements.

It is also preferred that the other elements include Cr, Zr, and V at concentrations of less than or equal to 0.03% each.

It is preferred that the coiled re-roll strip be allowed to cool naturally. This means cooling at a rate of less than about 150° C./hour. The coiled strip may be cooled at this rate to ambient temperature for convenience. At any rate it preferably cooled to less than 150° C.

It is preferred that the annealing step be carried out such that the strip is fully recrystallized after the annealing step.

In a fully recrystallized strip the mechanical energy introduced in the rolling step is fully relieved. At the same time the cube texture is maximized and the textures caused by the mechanical work are minimized.

The alloy is preferably cast to produce a strip having a thickness of less than 30 mm, and more preferably having a thickness of between 10 and 25 mm.

The re-roll strip preferably has a thickness of between 0.8 to 1.5 mm and more preferably between 1.0 and 1.3 mm.

The anneal is preferably selected from the group consisting of (a) continuous anneal to reach a peak metal temperature of 500 to 550° C. holding for 5 to 180 seconds followed by a quench to ambient in 120 seconds or less, (b) batch anneal at a temperature or between 425 to 510° C. for 0.25 to 6 hours, and (c) self-anneal by coiling after hot rolling at a temperature of at least 400° C. and allowing the coil to cool naturally to room temperature. The self anneal preferably involves coiling at a temperature of at least 425° C.

The time for batch anneal is the soaking time at temperature and excludes any coil heat up or cool down time.

When continuous or batch anneal steps are used it is preferred that the cast strip be rolled to re-roll gauge in a hot mill with an entry temperature of less than 450° C. and an exit temperature of less than 325° C. more preferably less than 300° C. The exit temperature is greater than 200° C. and preferably greater than 250° C. The entry temperature is more preferably between 400° C. and 440° C.

When a self anneal step is used, it is preferred that the cast strip be rolled to re-roll gauge in a hot mill with an entry temperature of at least 500° C. (preferably between 500° C. and 550° C.) and an exit temperature of at least 400° C., preferably at least 425° C.

It is preferred that the hot mill be of the tandem type.

The re-roll strip is rolled to final gauge using preferably greater than or equal to 76% reduction and preferably less than or equal to 80% reduction.

The final strip gauge is preferably between 0.26 and 0.30 mm.

The present invention is capable of producing a can body stock having a 45 degree earing of less than 3% and a yield strength after stoving of at least 38.5 ksi (265 MPa). The yield strength after stoving is measured following a typical stoving operation involving heating the strip to 195° C. for 10 minutes followed by natural cooling to ambient. Yield strengths after stoving are generally reduced from the yield strength of the as-rolled material for example by 2 to 4 ksi (15 to 30 MPa) for batch annealed material.

DETAILED DESCRIPTION OF THE INVENTION AND THE PREFERRED EMBODIMENTS

The slab is preferably cast using a twin belt caster such as one described in U.S. Pat. No. 4,061,177, the disclosure of which is incorporated by reference. Such a caster may use shot or sand blasted metal belts or may use ceramic coated metal belts with the desired roughness characteristics.

The Roles of the Alloying Elements

Silicon

If the Silicon exceeds 0.3% it is believed that magnesium silicide intermetallics will form, reducing the effective amount of magnesium present for strengthening. The lower limit for Silicon is a practical limit for commercially available materials.

Manganese

Manganese within the claimed range ensures adequate strength in the final product after stoving. If Mn exceeds the upper limit, too many dispersoids (very fine particles) form during the rolling of the cast strip to re-roll gauge which prevents adequate recrystallization during the annealing steps which then causes excessive earing in the final product. If Mn is less than the lower limit, the final product lacks strength after stoving.

Iron

Iron with the claimed range provides control of the cast grain structure. If Fe is too low, the cast grain size is too large and difficulties occur during rolling. If Fe is too high earing performance becomes poor.

Magnesium

Magnesium within the claimed range, along with copper and manganese provide adequate strength in the final product. If magnesium is too high, the final product will undergo excessive work hardening during drawing and ironing and be more prone to scoring. If magnesium is too low, the final product will have insufficient strength Copper Copper within the claimed range contributes to the strength of the product, and because it operates by a precipitation hardening mechanism, contributes to the retention of strength after stoving. If copper is to high, the final product will be susceptible to corrosion. If copper is too low, the amount of precipitation hardening will be insufficient to achieve the desired stoved strength.

Chromium, Vanadium and Zirconium

These elements increase the thermal stability of the alloy and if present in excess will upset earing control. They should preferably be less than 0.03%.

Rolling and Annealing Conditions

When can-body stock is made from conventional DC cast ingot, the ingot is homogenized then undergoes a large degree of deformation at high temperatures during hot rolling. The large amount of reduction and the rolling temperatures in the hot mill generally results in full recrystallization and the amount of cube texture generated during the recrystallization process is large. The homogenization step ensures that Mn is present in the form of coarse (e.g. 0.3 $\mu$m) dispersoids which do not impede the recrystallization process. Because the amount of cube texture generated is high, the material can be subsequently heavily cold worked without the 45° earing increasing beyond acceptable levels. As large amounts of cold work increase the yield strength of the material it is possible to achieve high yield strength can body stock with low earing under a wide range of processing conditions.

Continuously cast can body stock on the other hand is rolled to re-roll gauge with less reduction than DC cast ingots. Furthermore, there is generally no homogenization step used and therefore the large Mn dispersoids have not formed at this stage. During the rolling step, Mn can form very fine dispersoids under certain conditions of temperature and strain rate and these fine dispersoids inhibit recrystallization in subsequent annealing steps. Mn dispersoids appear to be best avoided either by operating the rolling process at elevated temperatures or by operating at relatively low temperatures and ensuring the time in the hot mill is minimized, since the dispersoid formation is time dependent. The second option (which might better be described as "warm rolling") results in low mill exit temperatures which are insufficient to permit self anneal to a fully recrystallized state even in the absence of Mn dispersoids but are suitable for other forms of annealing (CAL or batch).

Because of these requirements for processing continuously cast strip material, the amount of cube texture that can develop is limited, and it has been generally found that when subsequent cold work is used to increase the strength in the final gauge material, the resulting 45° earing is unacceptably high. This problem has been typically dealt with by introducing interanneal or similar heat treatments during the cold rolling in order to attempt to obtain adequate recrystallization at the same time as the strength develops through cold work. However, cold work prior to annealing yields less cube texture upon recrystallization than work at higher temperatures (e.g. warm rolling) prior to annealing, so that cold work at final gauge must be less than 70% in such two step processes.

In the present invention it is believed that the large amount of reduction used in the rolling of the cast strip to re-roll gauge (>83% and preferable higher) creates sufficient mechanical energy within the material such that the re-roll strip, when annealed in a subsequent step to full recrystallization conditions, achieves a sufficient amount of cube texture such that the cold work necessary to obtain the desired yield strength of the material does not destroy earing performance. It is believe that if sufficient mechanical work is delivered to the material before an annealing step takes place, there will be adequate development of cube texture during the anneal step even when starting with unhomogenized continuous cast strip. Because this mechanical work takes place at a temperature preferably greater than 200° C. or more, some recovery is believed to take place, which enhances the cube texture formation through alteration of the population of sites for nucleation of recrystallized grains. The annealing step can be carried out then without resorting to special conditions since if the cold rolling reduction falls within the relatively narrow claimed range (which represents a substantial amount of cold work) adequate strength can be developed without loss of earing. Because the annealing step is made more flexible, the step can be carried out "off line" after the re-roll strip has been coiled. This increases the process flexibility.

It is believed that if cold work (i.e. deformation at a temperature below 200° C. and more usually below 150° C.) is used between the hot or "warm" rolling and the anneal step of this invention, the loss of cube texture and/or increase of cold work textures in the strip cannot be restored by an anneal since the cold work occurs without any recovery, which results in a different population of nucleation sites less favourable to development of cube texture, and hence cold rolling with interanneal as carried out in the prior art is less effective at achieving the final product properties desired.

In the present invention, it has been found, surprisingly, that by ensuring a minimum of 83% hot work is used in the hot rolling stage, there is a performance window not heretofore known that becomes available at between 75 and 85% cold work (preferably 76 to 80% cold work) that gives suitable product performance even when material recrystallization is done in a discontinuous or "off-line" process (e.g. batch anneal, or CAL after removing the re-roll coil from the line). This results in a more flexible processing route and overcomes the problems present in both prior art approaches to continuous cast can body stock production.

The invention is illustrated by the following Examples, which are not intended to limit the overall scope of the present invention.

EXAMPLE 1

An Al can body alloy of composition Mg=1.48, Mn=0.97, Cu=0.43, Fe=0.32, Si=0.10 was cast on a continuous strip caster of the type described in U.S. Pat. No. 4,061,177 to a thickness of 15.8 mm. The cast strip was continuously fed to a two-stand hot mill where it was reduced by 92.4% to a re-roll gauge of 1.2 mm. The hot mill entry temperature was 410° C. and the exit temperature was 315° C. The re-roll strip was then coiled at a temperature of about 290° C. and allowed to cool to ambient temperature. A coil of this material was subject to a batch anneal where the coil was heated at a predetermined rate to an annealing temperature, held for a predetermined time then cooled to ambient. The resulting strip was then cold rolled using 76% reduction to final gauge. Two additional portions of the same re-roll material were batch annealed in the laboratory and cold rolled with the same reduction. Finally, a portion of the material was laboratory processed to simulate a continuous anneal process.

The annealing conditions and resulting properties are shown in Table 1 below where the YS of the as-rolled and stoved materials and the mean 45° earing of the as rolled and stoved material is shown. Stoving results in a negligible increase in earing, but a reduction in yield strength as noted above. The important parameters are the earing of the as-rolled sheet and the YS of the stoved material. In the examples of Table 1, for which the process fell within the claimed process, the YS and earing therefore met the requirements.

TABLE 1

| Anneal conditions | | | Stoved sheet | |
|---|---|---|---|---|
| Type | Heating rate | Hold temperature & time | YS (MPa) | 45° earing |
| Coil, batch | 25° C./h | 425° C./2 h | 290 | 2.4% |
| Lab, batch | 50° C./h | 429° C./2 h | 269 | 2.1% |
| Lab, batch | 10° C./h | 437° C./2 h | 266 | 1.5% |
| Lab, CAL | | 502° C. peak metal temp/1 min | 279 | 2.6% |

EXAMPLE 2

A sample of the same re-roll sheet as in Example 1 was subject to a laboratory batch anneal using a heating rate of 50° C./h and holding at 402° C. for 2 hours. After stoving the YS was 269 MPa and the 45° earing rose to 3.2%. This made the material marginal in terms of earing performance, and indicates that when the anneal temperature falls below the preferred range, earing performance becomes poor.

EXAMPLE 3

An alloy of the same composition as in Example 1 was cast under the same conditions then hot rolled to a re-roll gauge of 2.3 mm using 85.4% reduction. The hot mill entry temperature was 410° C. and the exit temperature was 305° C. The re-roll strip was coiled and allowed to cool to ambient. A sample of the re-roll strip was laboratory batch annealed using a heating rate of 25° C./h and holding at 425° C. for 2 hours. The strip was then cold rolled to final gauge using 88% reduction. The YS in the stoved condition was 298 MPa and the 450 earing was 4.4%. This indicates the effect of cold rolling outside the preferred range. The earing was substantially increased.

EXAMPLE 4

A sample of the re-roll strip of Example 3 was additionally cold rolled (at under 150° C.) to 1.1 mm (50% reduction) prior annealing. It was laboratory batch annealed as in the previous example, then cold rolled to final gauge using 76.6% reduction. The YS after stoving was 269 MPa and the earing was 4.2%. This indicates that the insertion of cold work prior to the anneal step (i.e. use of an interanneal) will have a detrimental effect on product performance even when the "warm" rolling conditions and final cold rolling reduction conditions are met.

What we claim is:

1. A process of manufacturing can body stock, consisting essentially of the steps of:

preparing a molten aluminum alloy containing Mg in the range 1.1 to 1.5% by weight, Mn in the range 0.4 to 0.9% by weight, Cu in the range 0.2 to 0.4% by weight, Fe in the range 0.2 to 0.7% by weight, Si in the range 0.07 to 0.3% by weight, all other elements each less than 0.05% by weight to a maximum of 0.2% for all other elements, casting the alloy in a continuous strip casting process to produce a slab having a thickness of at least 9 mm and less than 30 mm, rolling the slab using at least 83% reduction to produce a re-roll strip having a thickness of in the range of 0.8 to 1.5 mm, coiling the re-roll strip to form a coil and allowing the coil to cool naturally, annealing the re-roll strip, and cold rolling the strip to a final gauge of between 0.26 and 0.4 mm, using a reduction of between 75 and 85%, with no interanneal, wherein the final gauge sheet has a yield strength after stoving of at least 38.5 ksi (265 MPa) and a 450 earing of less than 3%.

2. A process according to claim 1 wherein said re-roll strip has a thickness of 1.1 to 1.3 mm.

3. A process according to claim 1 wherein said natural cooling takes place at a rate of less than about 150° C./hour.

4. A process according to claim 1 wherein said anneal is selected from the group consisting of (a) continuous anneal at a peak metal temperature of 500 to 550° C. for 5 to 180 seconds followed by quenching to room temperature within about 120 seconds, and (b) batch anneal at a temperature of between 425 to 510° C. for 0.25 to 6 hours.

5. A process according to claim 4 wherein said cast strip is rolled to said re-roll gauge on a hot mill having an entry temperature of less than about 450° C. and an exit temperature of less than about 325° C. but greater than 200° C.

6. A process according to claim 5 wherein said hot mill is a multi-stand tandem mill.

7. A process according to claim 1 wherein said anneal step is a self-anneal process involving coiling after rolling at a temperature of at least 400° C. and allowing the coil to cool naturally to room temperature.

8. A process according to claim 7 wherein said cast strip is rolled to said re-roll gauge on a hot mill having an entry temperature of at least 500° C. and an exit temperature of at least 400° C.

9. A process according to claim 1 wherein Cr, Zr and V are present to less than or equal to 0.03% each.

10. A process according to claim 1 wherein said reduction during cold rolling is between 76 and 80%.

* * * * *